United States Patent [19]

Freeman

[11] 3,999,940

[45] Dec. 28, 1976

[54] MULTICOLORED PILE MATERIALS AND PROCESSES FOR MAKING THE SAME

[75] Inventor: Ronald Edward Freeman, Cartersville, Ga.

[73] Assignee: Congoleum Corporation, Milwaukee, Wis.

[22] Filed: Jan. 2, 1975

[21] Appl. No.: 538,077

[52] U.S. Cl. ..... 8/14; 8/15; 8/65; 8/69; 8/1 XB; 428/90

[51] Int. Cl.[2] ..... D06P 5/12

[58] Field of Search ..... 8/14, 15, 65, 69, 1 XB

[56] References Cited

UNITED STATES PATENTS

| | | | |
|---|---|---|---|
| 545,420 | 8/1895 | Bamford | 8/65 |
| 617,772 | 1/1899 | Rettig | 8/14 |
| 803,421 | 10/1905 | Kubler | 8/14 |
| 997,101 | 7/1911 | Swenning | 8/14 |
| 1,253,050 | 1/1918 | Kitsee | 8/14 |
| 1,467,136 | 9/1923 | Creasey | 8/14 |
| 2,816,811 | 12/1957 | Tillett | 8/14 |
| 2,895,785 | 7/1959 | Alsberg | 8/65 |
| 3,393,411 | 7/1968 | McElveen | 8/14 |
| 3,467,484 | 9/1969 | Hermes | 8/65 |
| 3,468,694 | 9/1969 | Moritz | 8/65 |
| 3,663,157 | 5/1972 | Gilgien | 8/65 |
| 3,700,402 | 10/1972 | Noda | 8/65 |
| 3,788,805 | 1/1974 | Ookubo | 8/21 A |

FOREIGN PATENTS OR APPLICATIONS

| | | |
|---|---|---|
| 17,276 | 1892 | United Kindom |
| 9,029 | 1893 | United Kingdom |
| 18,487 | 1898 | United Kingdom |

*Primary Examiner*—Paul R. Michl

*Attorney, Agent, or Firm*—Richard T. Laughlin

[57] ABSTRACT

Multicolored pile materials, and particularly pile carpets, comprising a fabricated backing and a fabricated pile face having: (1) upper pile face portions which have a predetermined color; and (2) lower pile face portions which have a color which is different and darker than the predetermined color of the upper pile face portions, whereby unusual multicolored effects are obtained; and, more specifically, multicolored pile fabrics, and particularly pile carpets, comprising a fabricated backing and a fabricated pile face having: (1) upper pile face portions which are substantially white in color; and (2) lower pile face portions which have a color which is different and darker than white, whereby unusual multicolored, frosted effects are obtained. Processes for making such multicolored or frosted pile materials are also included.

8 Claims, 3 Drawing Figures

MULTICOLORED PILE MATERIALS AND PROCESSES FOR MAKING THE SAME

GENERAL BACKGROUND OF THE INVENTION

In the production of pile materials and floor coverings, such as pile carpets and rugs, it has always been desired to enhance the surface interest and appearance of such pile materials to provide increased decorative and esthetic appeal. One of the commonest ways has been through the use of colors in the pile face yarns to create a desired bright, intense, or vivid effect; or a quiet, restful, or subdued effect; or a rich, brilliant, or glowing effect, etc. Another way has been to combine differently colored pile face yarns in side-by-side predetermined design relationships, or in a random relationship, to achieve a two-tone, three-tone, or similar multi-toned effect. Many of these efforts have been very successful and commercially very acceptable. However, it has always been desired to create new and attractive colored or multicolored effects.

GENERAL PURPOSES AND OBJECTS OF THE INVENTION

It is a principal purpose and object of the present invention to create novel pile materials, and particularly novel pile carpets and rugs, having unusual multicolored effects.

It is another principal purpose and object of the present invention to create novel pile materials, and particularly novel pile carpets and rugs, having unusual multicolored frosted effects.

It is still another principal purpose and object of the present invention to provide novel processes whereby such novel pile materials, and particularly novel pile carpets and rugs, can be made.

BRIEF SUMMARY OF THE INVENTION

It has been discovered that these purposes and objects, as well as other purposes and objects which will become apparent from a further reading of this specification, can be obtained in pile materials comprising a fabricated backing and a fabricated pile face by: (1) treating the pile face of the pile materials with a dye and then, while the dye is still wet and before it has become set; (2) treating the upper portions of the pile face substantially uniformly to a predetermined depth with a resist chemical material capable of displacing the dye from the upper portions of the pile face; (3) exposing the pile materials to a dye setting treatment to set the dye in the lower portions of the pile face; and (4) washing the pile materials to wash out the dye and the resist chemical materials from the upper portions of the pile face without substantially affecting the dyed lower portions of the pile face, whereby the unusual multicolored effects are obtained in the pile materials.

Alternatively, such multicolored effects are obtained in pile materials by: (1) treating the upper portions of the pile face thereof before the pile materials have been dyed or colored, or while they are still greige (uncolored), substantially uniformly to a predetermined depth with a resist chemical material capable of affecting the dye receptivity of such upper portions; (2) setting the resist chemical material such as by a steaming operation; (3) drying the pile materials; (4) treating the pile materials with a dye which dyes or colors the lower portions of the pile face without affecting the upper portions thereof; and (5) washing the pile materials to remove undesired resist chemical materials, dyes, etc.

The invention will be more particularly described and illustrated with specific reference to pile carpet materials but such is to be considered as merely illustrative and is not to be construed as limitative of the broader aspects of the present invention.

The invention will be better understood from the following detailed specification and from the accompanying self-explanatory drawings wherein there are described and illustrated preferred embodiments of the invention. The invention, however, is not to be construed as limited to such preferred embodiments which are illustrative and not limitative of the broader aspects of the inventive concept.

BRIEF DESCRIPTION OF THE DRAWINGS

Referring to the accompanying drawings which, incidentally, are not precisely drawn to scale and wherein certain elements are increased or decreased in size for the purposes of a clearer, more understandable illustration.

DETAILED DESCRIPTION OF THE INVENTION

Figure 1:
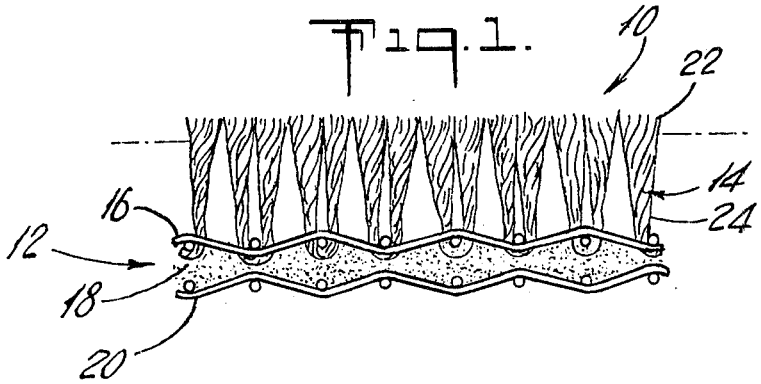
FIG. 1 is an enlarged, schematic, fragmentary cross-sectional view of a portion of a tufted pile carpet embodying the principles of the present invention.

In the preferred embodiment of the invention illustrated in FIG. 1, there is shown a portion of a tufted pile carpet 10 comprising a fabricated backing 12 and a fabricated pile face 14. The fabricated backing 12, as shown, comprises an upper, woven, primary backing fabric 16 into which the pile yarns have been stitched and then secured thereto additionally as by an adhesive 18. A lower, woven, secondary backing fabric 20 is then laminated to the adhesive and the primary backing fabric 16, primarily to reinforce and strengthen the same. The pile face 14 stitched to the primary backing 16 comprises an upper pile face portion 22 and a lower pile face portion 24. These are shown as divided by the dotted line.

THE FABRICATED BACKING FABRICS

The fabricated backing fabrics 16 and 20 are shown in the drawings as woven fbrics but this is not necessary or essential. The fabricated backing fabrics 16 an 20 may be knitted, bonded nonwoven, or other kinds of fabricated materials. They may be made of jute fibers, or kraftcord, or cotton, hemp, flax or linen fibers such as used in canvas or duck or the like, particularly in the case of the outer or secondary backing fabric 20. Or, particularly in the case of the inner primary backing fabric 16, they could be made of these fibers or other natural fibers, or of synthetic or man-made filaments or spun yarns such as polyesters, acrylics, modacrylics, polyolefins such as polypropylene, polyamides such as nylon 6, nylon 6/6, etc. It is not essential that there be two backing fabrics. There may be more than two or, in many cases, the lower or outer secondary backing fabric 20 may be omitted in the interests of economy, weight, etc.

THE ADHESIVE

The nature of the back coating or the adhesive material 18 does not relate to the essence of the invention and the particular adhesive material which is used may be selected from any one of a large class of conventional adhesive materials known and used in industry. Epoxy, polyester, amino, acrylic, butadiene-styrene, and many other resins are typical examples of classes of suitable adhesive materials. The essential purpose of the adhesive 18 is to lock the lower, looped portions of the pile yarns in position, as shown, between the upper woven primary backing fabric 16 and the lower woven secondary backing fabric 20, and to adhere these backing fabrics together. The back coating or adhesive is applied in an amount ranging from about 20 to about 32 ounces per square yard (finished weight) and preferably from about 24 to about 28 ounces per square yard (finished weight), depending primarily upon the weight of the pile fabric involved, its intended use, etc.

THE PILE FACE

The pile face 14 may be made of substantially any type of continuous filament or fiber. For example, there may be used any synthetic or man-made continuous filament or spun fiber, such as polyamides in their various forms, such as nylon 501, nylon 6, nylon 6/6, etc., polyolefins, acrylics, modacrylics, polyesters, rayon, etc. Natural fibers such as cotton, wool, mohair, etc, are also of use.

The pile face 14 may be cut or uncut loop, and may be shag, plush, sculptured, level, or any one of the known forms presently available. The height or depth of the pile face may vary within relatively wide limits and may be as short as ⅜ inch, or as long as about 2½ inches, as desired or required.

As used herein, the pile height is the average length of the pile tufts, as measured in a vertical plane. Also, as used herein, the pile thickness is the average thickness of the pile yarn material as measured vertically above the backing of the fabric it is stitched to, as measured under a specific standard testing pressure. Other definitions are as set forth in A.S.T.M. Standard D 418-68.

As shown by the substantially horizontal, dotted dividing line in FIG. 1, the pile face 14 is divided into an upper pile face portion 22 and a lower pile face portion 24. For reasons which will become clear from a further reading of this specification, the color of the upper pile face portions 22 is substantially white or a relatively light color, whereas the lower pile face portions 24 have a different and a relatively darker color. This multicolored effect is obtained by means of the processes of the present invention to be described hereinafter. In some cases, the multicolored effect has a "frosted" appearance, the obtaining of which will also be described hereinafter.

The term different and "darker", as used herein, is used in its natural or dictionary meaning and sense. Specifically, the term darker color means a color which is less capable of receiving, reflecting, transmitting, or radiating light. To explain, a black color is less capable of receiving, reflecting, transmitting, or radiating light than a color such as green, and hence black is darker than green. In the same way, green is less capable of receiving, reflecting, transmitting, or radiating light than white and hence green is darker than white.

In order to obtain the multicolored "frosted" effects of the present invention, the depth of the upper portions of the pile face ranges from about ⅛ inch to about ¼ inch. Those particular styles of carpeting requiring maximum wearability generally have depths closer to the ¼ inch value. In those particular styles where wearability is not an essential factor, the depths are closer to the ⅛ inch value. In any event, the average depths of the frosted upper portions of the pile face are in the range of from about 10% to about 33% of the total average thickness of the pile face.

THE COLORING MATERIAL OR DYE

The specific nature and type of the coloring material or dye which is applied to the portions of the pile face does not relate to the essence of the invention and its selection is determined by: the type and nature of the filaments or fibers which are used in the pile face; the purpose and use of the pile carpet; the result and effect to be obtained; etc. In general, it may be stated that acceptable dyes for use with cellulosic fibers are vat dyes, sulfur dyes, azoic dyes, reactive dyes, etc. Acceptable dyes for polyamide nylon fibers are acid dyes, reactive dyes, vat dyes, etc. Acceptable dyes for wool are vat dyes, reactive dyes, acid dyes, direct dyes, etc. These dyes are conventional dyes and are applied basically under conventional or normal conditions now known in the art. A few examples of typical dyes are: Yellow RGRLL, Red F4BLL, and Blue BRL which will be referred to in greater particularity hereinafter.

Other dyes of applicability and utility within the principles of the present invention are the "LANASOL" dyes manufactured by Ciba-Geigy, such as: Yellow 4GN, Blue 3R, Red B, Yellow 4G, Red G, Red 5B, Red 6G, Scarlet 2R, Scarlet 3G, Orange G, Orange R, Blue 3G, etc.

Other dyes of use are the "SIRIUS" dyes manufactured by Verona Dyestuffs, Division of Verona-Pharma Chemical Corporation, such as: Yellow 2GC, Supra Yellow FGR-LL, Supra Yellow GD, Supra Yellow RO, Supra Orange 3GLD CF, Supra Orange 4G, Supra Orange R, Supra Blue BRL, Supra Blue FGG, Supra Blue F3GL, Supra Blue F5G-LL, Supra Blue 5GA, Supra Blue 2RL, Supra Turquoise LG, Supra Green GL, Supra Green 3G 167%, etc., as well as the "BENZAMIN" dyes also manufactured by Verona Dyestuffs, such as: Orange BRS 200%, Orange GR, Orange GRN 150%, Orange GXCW 200%, Green FB 150%, etc.

These dyes may be applied to the pile face of the carpet in many ways such as by continuous dyeing, pad dyeing, blotch screen printing, etc. The fluidity or viscosity of these dyes is usually adjusted by the addition of desired amounts of aqueous media, or viscosity changing agents or thickeners, such as Syngum D-47-D, gum guar, gum karaya, Halltex KRS-H, etc. A few typical dye formulations are:

| | |
|---|---|
| (1) Yellow RGRLL | 60 grams per 20 Liters |
| (2) Red F4BLL | 4.5 grams per 20 Liters |
| (3) Blue BRL | 3.0 grams per 20 Liters |

These dye formulations are mixed with the Syngum D-47-D, 15 grams per liter, at a pH of about 7, and applied to the pile yarns by continuous dyeing, pad dyeing, blotch screen printing, etc.

THE RESIST CHEMICAL MATERIAL

The specific resist chemical material which is applied to the upper portions 22 of the pile face may be selected from a large class of materials known to be suitable for the purpose, depending upon the nature, properties, and characteristics of the particular filament or fiber being treated, the specific dye or coloring material being used, etc. Specific examples of resists are: Irgaprint PA; aluminum acetate; zinc acetate; tannic acid; "Aconyl PW", a sulfonated condensation product; "Nylon Resist", a phenyl sulfonic acid derivative; "Nyzist", an organic sulfonate; "Thiotan", a sulfurized phenolic condensate; etc.

The fluidity or viscosity of these resist chemical materials is usually adjusted by the addition of desired amounts of aqueous media, or viscosity changing agents or thickeners, such as listed previously herein. One typical resist chemical material formulation is:

| | |
|---|---|
| Irgaprint PA (Ciba-Geigy) | 25 grams per Liter |
| Water-Syngum D-47-D Mixture (1.6% Syngum; 98.4% Water and Dyes) | 4 Liters |
| pH 7 | |

The percentage of thickener and the amount of the resist chemical material controls or restricts the extent of the penetration of the resist chemical formulation into the upper portion of the pile face and creates a level of lighter color on the top surface over the different and darker base shade.

The resist chemical formulations may be applied in many different ways such as by spraying (manually or mechanically), stencil or screen printing (rotary, flat-bed, or Stalwart type roller), or by other techniques known in the art. The resist chemical material is capable of changing the dye receptivity of the upper portions of the pile face to which it is applied and is capable of displacing the dye or coloring material from these upper portions of the pile face.

The further functioning and purpose of the resist chemical will become clearer from a further reading of this specification relating to the process or procedural aspects which are involved.

THE MODIFICATION OF FIG. 2

In FIG. 1, a tufted pile carpet 10 was used to show a preferred embodiment of the inventive concept. This, however, was primarily illustrative of the invention and was not to be construed as limitative of the broader aspects which are involved. Other conventional pile fabrics which are woven, knitted, bonded flocked (electrostatically or mechanically), needle punched, etc., may also be used. The essential element that all of these fabrics must have in common is a pile face, the upper portions of which are to have a white or relatively light color and lower portions which are to have a different and a darker color. Such other fabrics are prepared by conventional fabricating processes and techniques on standard, conventional weaving, knitting, flocking, needle punching, or other fabricating machines, known to the art.

Figure 2:
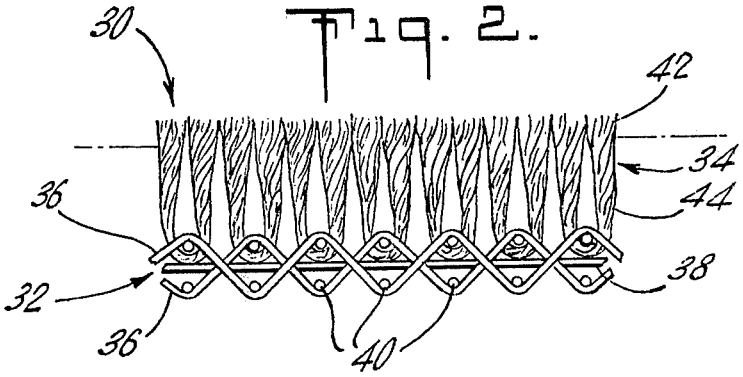
FIG. 2 is an enlarged, schematic, fragmentary cross-sectional view of a portion of a woven pile carpet, also embodying the principles of the present invention.

In FIG. 2, there is shown one of these other embodiments, namely, a woven pile carpet 30 comprising a fabricated backing 32 and a fabricated pile face 34. The fabricated backing 32, as shown, comprises warp yarns 36, 36; stuffer warp yarns 38; filling or weft yarns 40; and the pile face 34 which comprises an upper pile face portion 42 and a lower pile face portion 44. The pile face 34 may be made of substantially any type of continuous filament or spun yarn, as previously described herein, and may be cut or uncut loop, etc., and may have heights as previously described. The principles of the present invention are equally applicable to such woven pile materials and to other pile surfaces, as well.

THE MODIFICATION OF FIG. 3

It is also to be appreciated that the principles of the present invention are equally applicable to pile carpets and rugs or other pile materials wherein the pile loops are uncut, in distinction to the pile carpets of FIGS. 1 and 2 wherein the pile loops are illustrated as cut.

Figure 3:
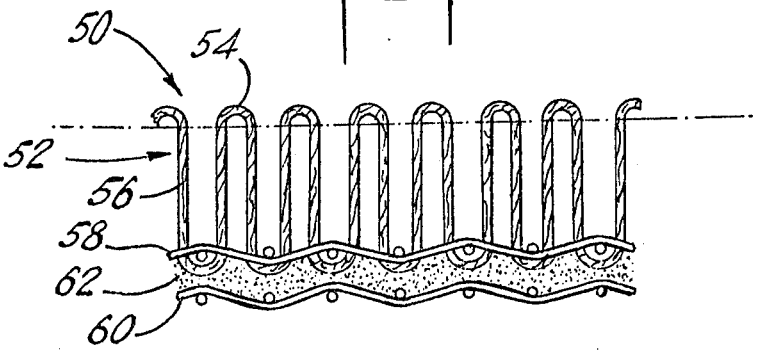
FIG. 3 is an enlarged, schematic, fragmentary cross-sectional view of a portion of another tufted pile carpet also embodying the principles of the present invention.

Such a pile carpet having uncut loops is illustrated in FIG. 3, wherein there is shown a pile carpet 50 which generally resembles the tufted pile carpet 10 of FIG. 1 but wherein the pile loops 52 are not cut. These pile loops 52 have upper portions 54 and lower portions 56 which are colored differently by processes and procedures using dyes and resist chemical formulations as previously described with reference to FIG. 1. A fabricated primary backing 58, a fabricated secondary backing 60, and a back coating or adhesive 62 are also as described previously. The spacing of the uncut loops 52 may be less than that of FIG. 1 in order to increase the covering power thereof which is lost to some extent by the fact that the pile yarns are not cut and do not splay or fan outwardly.

THE PROCESS OF THE INVENTION

The process of the invention will be described in greater particularity with reference to the tufted pile carpet shown in FIG. 1. This, however, is illustrative of the preferred process embodiment which can be applied equally well to other pile fabrics as mentioned herein. The tufted pile carpet of FIG. 1 is preferably made by conventional manufacturing processes using known tufting machines. The pile face 14 of the pile carpet materials is then treated with the dyeing or coloring composition such as by conventional continuous dyeing, pad dyeing, blotch screen printing, etc. Then, while the dye or coloring composition is still wet and before it has become set, the upper portions of the pile face 14 are treated substantially uniformly to a predetermined depth with a selected resist chemical composition. This resist chemical is capable of changing the dye receptivity of the upper pile portions so treated and is capable of displacing the dye or color from the upper portions of the pile face. The pile carpet materials are then exposed to a dye setting treatment which is usually a steaming or equivalent operation. The pile carpet materials are then washed to remove the displaced dye or color from the upper portions of the pile face which becomes white or colored depending upon their previous coloration or condition and the color desired therein.

It is also to be appreciated that it is not necessary to fabricate the pile carpet or other pile material prior to the treatment of the upper portions of the pile yarns with the protective resist chemical and the treatment of the pile carpet with the dye or other coloring material. Through the use of yarns which have been pretreated with the resist chemical material prior to the fabricating process, spaced precolored, span-dyed, space-dyed, skein-dyed yarns, or like yarns that are designed through spaced color positions on each yarn, a color or multicolor effect can be created in the upper level of the yarn tufts and a different and darker color on the lower portion or portions of the yarn tufts, whether the pile fabric which is subsequently made from such yarns is tufted, woven, knitted, bonded flocked (electrostatically or mechanically), needle punched, etc.

Still another variation of the preferred embodiment of the present invention is a two-pass or two-step process or system wherein the pile carpet or other pile material is initially fabricated in the greige (uncolored) and the resist chemical material is applied to the upper portions of the pile face to the predetermined depth, whereby the dye receptivity is changed therein, as previously described, without affecting the dye receptivity of the lower portions of the pile face. The resist chemical material may then be set, such as by a steaming or equivalent operation, and the pile carpet or pile material is then dried. Thereafter, dye or other coloring material is applied in a pad, beck, or continuous dyeing system, or by other known dyeing methods. The dye or other coloring material is then set, such as by a steaming operation, and the pile material is ready for washing or other conventional finishing operations. Naturally, during the washing, the dye or color is removed from the upper portions of the pile face, wherein the dye was not effectively applied due to the resist, and such upper portions naturally revert to their previous coloration which is greige (uncolored).

The invention will be described in greater detail by reference to the following specific examples wherein there are illustrated preferred embodiments of the inventive concept. Such, however, is merely for purposes of illustration and the broader aspects of the present invention are not to be construed as limited thereto. Also, in these examples, as well as other references in this specification, unless stated otherwise or a contrary fact situation is indicated, all formulas are stated in percentages by volume.

EXAMPLE I

The tufted pile carpet of FIG. 1 is manufactured by conventional techniques and has the following specifications: the pile tufts are continuous filament polyamide nylon, 1300/2, 68 filaments per ply, 136 filaments per two-ply tuft; the pile height is ¾ inch and the face weight is 24 ounces per square yard. The tufting machine specifications are: 5/16 gauge, 1 end per needle, 7.5 stitches per inch, face yarn density: 1152. The primary backing is woven polypropylene, 3.5 ounces per square yard. The secondary backing fabric is a conventional woven jute. The adhesive composition is a butadiene-styrene latex and is applied in an amount equal to 24 ounces per square yard (finished dry weight).

The dyeing composition is as follows: Erionyl Floxine BL (2.80 grams per liter) is mixed with Syngum D-47-D (4.67 grams per liter), Sequestrene 30A (1 gram per liter), at a pH of 7.0. This formulation is applied by continuous dyeing to the pile carpet. It provides a base color to which the following mixture is applied by overprinting.

| | |
|---|---|
| Latyl Cerise Y | 0.20 grams per liter |
| Syngum D-47-D | 12.80 grams per liter |
| Sequestrene 30A | 1.00 grams per liter |
| Acetic Acid | 40.00 grams per liter |
| Cibaphasol AS | 4.80 grams per liter |

-continued

| | |
|---|---|
| Irgafomal SZE | 2.40 grams per liter |
| Irgaprint PA | 25.00 grams per liter |
| Irgasolvent P | 30.40 grams per liter |

The resist chemical has the following formulation in grams per liter:

| | |
|---|---|
| Irgaprint PA (Ciba-Geigy) | 30.0 |
| Syngum D-47-D (Stein-Hall) | 12.5 |
| Cibaphasol (Ciba-Geigy) | 5.0 |
| Trisodium Phosphate | 10.0 |
| pH is 8.5 | |

The resist chemical is applied to the upper portions of the pile face by means of hand screen printing. The average depth of penetration is from about ⅛ inch to about 3/16 inch. The resist chemical affects the dye receptivity of the yarn tufts it contacts and displaces the color from the yarn tips. The dye is then set by a steaming operation. The color that is displaced from the upper portions of the yarn tufts is ultimately washed out after steaming. The multicolored effect which is obtained is excellent.

EXAMPLE II

The procedure of Example I are followed substantially as set forth therein with the exception that the resist chemical composition is changed to:

4% Nylon Resist A (Verona)
2% Acetic Acid (56%)
1% Syngum D-47-D (Stein-Hall)

The resuls ar generally comparable to the results of Example 1. The multicolored frosted effect is excellent.

EXAMPLE III

The procedure set forth in Example I are followed substantially as described therein with the exception that the resist chemical composition is changed to:

4% Nylon Resist A
4Acetic Acid (56%)
0.5% Syngum D-47-D

The results are generally comparable to the results of Example I. The multicolored frosted effect is excellent. The upper portions of the pile face have a frosted snowy coloration whereas the lower portions of the pile face have a brilliant cerise coloration. This effect is noted in Examples I and II also.

EXAMPLE IV

The procedures of Example I are followed substantially as set forth therein with the exception that the dye composition is:

| | |
|---|---|
| Yellow RGRLL | 60 grams per 20 liters |
| Syngum D-47-D | 15 grams per liter |
| pH 7.0 | |

This provides a base color to which is applied by overprinting the following resist solution of 25 grams per liter of Irgaprint PA and 4 liters of a mixture of water and Syngum D-47-D, pH 7.0. (1.6% Syngum; 98.4% water and dyes).

The results are generally comparable to the results of Example I. the multicolored or split-level frosted effect is excellent with the lower portions of the pile yarns having a yellow coloration rather than the cerise of Example I.

EXAMPLE V

The procedures of Example I are followed substantially as set forth therein with the exception that the dye composition is:

| | |
|---|---|
| Red F4BLL | 4.5 grams per 20 liters |
| Syngum D-47-D | 15 grams per liter |
| pH 7.0 | |

This provides a base color to which is applied by overprinting a resist composition comprising 25 grams per liter of Irgaprint PA and 4 liters of a mixture of water and Syngum D-47-D, as described previously.

The results are generally comparable to the results of Example. The multicolored split-level frosted effect is very interesting and is considered excellent, this time with a lower portion coloration of red.

EXAMPLE VI

The procedures of Example I are followed substantially as set forth therein with the exception that the dye composition now contains:

| | |
|---|---|
| Blue BRL | 3 grams per 20 liters |
| Syngum D-47-D | 15 grams per liter |
| pH 7.0 | |

This provides a base color to which is applied by overprinting a resist composition comprising 25 grams per liter of Irgaprint PA and 4 liters of a mixture of water and Syngum D-47-D, pH 7.0, as described previously.

The results are generally comparable to the results of Example I. The multicolored frosted effect is excellent, this time with a base blue coloration.

EXAMPLE VII

The procedures of Example I are followed substantially as set forth therein with the exception that the average depth of the penetration of the resist chemical is increased to from about 3/16 inch to about ¼ inch. The multicolored effect is deeper than that obtained in Example I but otherwise the results are generally similar.

EXAMPLE VIII

The procedures of Example I are followed substantially as set forth therein with the exception that the pile carpet is a velvet weave such as illustrated in FIG. 2.

The multicolored split level effects which are obtained are generally comparable to those obtained in Example I. The carpet is very acceptable from a commercial viewpoint.

EXAMPLE IX

The procedures of Example I are followed substantially as set forth therein with the exception that the pile carpet is an uncut loop tufted pile carpet such as illustrated in FIG. 3.

The multicolored split level effects which are obtained are generally comparable to those obtained in Example I. The carpet is very acceptable from a commercial viewpoint.

EXAMPLE X

The procedures of Example I are followed substantially as described therein insofar as the described pile carpet materials and the formulations are concerned. However, the order of the procedures and the application of the resist chemical formulation and the dyeing composition is reversed. The resist chemical formulation of Example I is applied to the upper portions of the pile face of the greige (uncolored) pile carpet when it is delivered from the tufting machine. It is then steamed and dried. Then, the dyeing composition on Example I is employed and is applied to the pile carpet in a continuous dyeing operation in a second pass or second step. The upper portions of the pile face, having been pretreated with the resist chemical, do not take the dye whereas the lower portions of the pile face do take the dye. Basically, the same styling multicolored effects are achieved and the results are generally comparable to the results obtained in Example I. The resulting pile carpet is commercially very acceptable.

Although several specific examples of the inventive concept have been described, the same should not be construed as limited thereby nor to the specific features mentioned therein but to include various other equivalent features as set forth in the claims appended hereto. It is understood that any suitable changes, modifications and variations may be made without departing from the spirit and scope of the invention.

For example, although it is preferred to apply the resist chemical material substantially uniformly to the upper portions of the pile face, particularly in order to obtain the frosted effect, such is not essential. In some cases, an irregular or random effect may be desired. In such case, less care is required to insure the uniformity of the application of the resist chemical materials.

Also, basically any type of dyeing process may be employed and a few of the more common processes are defined herewith as follows: In continuous dyeing, the material is impregnated with dye and then is passed through a series of developing, washing, and drying zones to a final take-up roll. The pad-steam system comprises rollers which apply dye and necessary materials to the materials and development takes place on continuous passage through a steam chamber. The pad-roll system uses an insulated oven in which a huge roll of materials, previously saturated with dye solution, slowly turns until the dye has become fixed to the fiber. A jig promotes dyeing by winding the materials through the dye bath, back and forth from one roll to another roll. A beck comprises an elliptical reel which draws the materials sewn in an endless chain from the dye bath and plaits it back into the bath repeatedly until dyeing is complete. Other processes are, of course, possible.

| Commercial Name | Color Index Generic Name | Color Index Constitution Number | Chemical Class |
|---|---|---|---|
| "LANASOL" Dyes | | | |
| Blue 3R | C.I. Reactive Blue 50 | | Anthraquinone |
| Red B | C.I. Reactive Red 65 | | Azo |
| Yellow 4G | C.I. Reactive Yellow 39 | | Azo |
| Red G | C.I. Reactive Red 83 | | Monoazo |
| Red 5B | C.I. Reactive Red 66 | | Azo |
| Red 6G | C.I. Reactive Red 84 | | Monoazo |
| Scarlet 2R | C.I. Reactive Red 78 | | Monoazo |
| Orange G | C.I. Reactive Orange 29 | | Azo |
| Blue 3G | C.I. Reactive Blue 69 | | Anthraquinone |
| "SIRIUS" Dyes | | | |
| Red F4BLL | Direct Red 212 | | Trisazo |
| Blue BRL | Direct Blue 98 | 23155 | Disazo |
| Yellow 2GC | Direct Yellow 44 | 29000 | Disazo |
| "SUPRA SIRIUS" Dyes | | | |
| Yellow GD | Direct Yellow 110 | | Disazo |
| Yellow RO | Direct Yellow 50 | 29025 | Disazo |
| Orange 3GLD-CF | Direct Orange 57 | | |
| Orange 4G | Direct Orange 72 | | Disazo |
| Orange R | Direct Orange 67 | | Stilbene |
| Blue BRL | Direct Blue 98 | 23155 | Disazo |
| Blue 5GA | Direct Blue 218 | 24401 | Disazo (metal complex) |
| Blue 2RL | Direct Blue 80 | | Disazo (metallised) |
| Turquoise LG | Direct Blue 86 | 74180 | Phthalocyanine |
| Green GL | Direct Green 68 | | Azo |
| "BENZAMIN" Dyes | | | |
| Orange BRS 200% | Direct Orange 80 | | Disazo |
| Orange GR | Direct Orange 80 | | Disazo |
| Orange GRN 150% | Direct Orange 78 | | Trisazo |
| Orange GXCW 200% | Direct Orange 73 | 25200 | Trisazo |
| Green FB 150% | Direct Green 45 | | Polyazo |
| "LATYL" Dye | | | |
| Cerise Y | Disperse Red 55 | | Anthraquinone |
| "ERIONYL" Dye (Erio) | | | |
| Floxine BL 167% | Acid Red 37 | 17045 | Monoazo |

Source of data: The Colour Index, Third Edition, 1971.

Syngum D-47-D is a natural gum derivative, cold water swelling thickener for carpet dyeing.

Gum guar is a natural gum thickening agent.

Gum karaya is a natural gum thickening agent.

Halltex KRS-H is a sodium alginate print paste thickener.

"SEQUESTRENE" 30A sequestering agent for calcium, copper, iron, etc. is the tetrasodium salt of ethylene diamine tetraacetic acid.

"CIBAPHASOL" AS leveling and penetrating agent for continuous dyeing and printing is a sulfuric acid ester, anionic.

"IRGAFOMAL" S2E foam control agent is a proprietary blend of hydrocarbons, terpenes, nonionic emulsifier, metallic soaps and silicone.

"IRGASOLVENT" P leveling, migrating and stripping agent is an inhibited high molecular weight alcohol.

What is claimed is:

1. A process of creating unusual multicolored effects in pile materials comprising a fabricated backing and a fabricated pile face which comprises: treating the upper portions and the lower portions of the pile face of the pile materials with a dye; treating only the upper portions and not the lower portions of said pile face with a resist chemical material, while said pile face and said dye are still wet and before said dye has been set, said resist chemical material being capable of displacing said dye from said upper portions of said pile face and changing the dye receptivity of said upper portions of said pile face; exposing said upper portions and said lower portions of said pile face of said pile materials to a dye setting treatment while said pile face is still wet, which sets said dye in the lower portions of said pile face without setting said dye in the upper portions of said pile face; and washing said pile materials to remove from said upper portions said resist chemical material and said dye which was not set therein.

2. A process as defined in claim 1 wherein said resist chemical material is applied substantially uniformly to said upper portions of said pile face to an average depth of from about ⅛ inch to about ¼ inch.

3. A process as defined in claim 1 wherein said resist chemical material is applied substantially uniformly to said upper portions of said pile face to an average depth of from about 10% to about 33% of the total thickness of the pile face.

4. A process as defined in claim 1 wherein the dye setting treatment is a steaming operation.

5. A process as defined in claim 1, wherein said fabricated backing comprises an upper, woven primary backing fabric and a lower, woven secondary backing fabric.

6. A process as defined in claim 1, wherein said fabricated backing comprises a woven backing fabric.

7. A process as defined in claim 1, wherein said pile face comprises cut loops.

8. A process as defined in claim 1, wherein said pile face comprises uncut loops.

* * * * *

Notice of Adverse Decision in Interference

In Interference No. 99,822, involving Patent No. 3,999,940, R. E. Freeman, MULTICOLORED PILE MATERIALS AND PROCESSES FOR MAKING THE SAME, final judgment adverse to the patentee was rendered Apr. 12, 1979, as to claims 1 and 4.

[*Official Gazette September 4, 1979.*]